US005374790A

United States Patent [19]

Horvath

[11] Patent Number: 5,374,790

[45] Date of Patent: Dec. 20, 1994

[54] LIQUID LEVEL SWITCH ASSEMBLY

[75] Inventor: Agoston Horvath, Plano, Tex.

[73] Assignee: Rochester Gauges, Inc., Dallas, Tex.

[21] Appl. No.: 969,085

[22] Filed: Feb. 5, 1993

[51] Int. Cl.[5] ..... H01H 35/18

[52] U.S. Cl. ..... 200/84 C; 73/313; 338/33; 340/625

[58] Field of Search ..... 307/118; 338/33, 172, 338/198, 200; 200/61.04, 61.52, 84 C; 335/205, 207; 73/DIG. 5, 308, 313, 317; 340/618, 623, 625

[56] References Cited

U.S. PATENT DOCUMENTS

| | | | |
|---|---|---|---|
| 1,481,322 | 1/1924 | Kellum | 73/313 |
| 3,051,805 | 8/1962 | Binford | 200/87 |
| 3,632,925 | 1/1972 | Fujiwara | 200/84 C |
| 3,751,616 | 8/1973 | Innes | 200/84 C |
| 3,868,485 | 2/1975 | Sykes et al. | 200/61.04 |
| 3,989,911 | 11/1976 | Perry | 200/83 L |
| 4,499,347 | 2/1985 | Richards | 200/81.9 M |
| 4,513,185 | 4/1985 | Walters | 200/84 |
| 4,691,185 | 9/1987 | Loubier | 335/207 |
| 4,870,861 | 10/1989 | Ohtani | 73/317 |
| 4,911,011 | 5/1990 | Fekete | 73/313 |
| 4,928,526 | 5/1990 | Weaver | 73/313 |

*Primary Examiner*—Gerald P. Tolin

*Attorney, Agent, or Firm*—Richards, Medlock & Andrews

[57] ABSTRACT

A liquid level switch assembly is provided which can be adjusted as to what liquid level will actuate the switch. A support bracket is mountable to the tank and a float arm is pivotally mounted to the support bracket inside the tank by way of a pivot axle. A magnet is mounted to the pivot axle such that the magnet rotates as the float arm pivots to follow the liquid level on the tank but such that the angular position of the poles of the magnet can be adjusted relative to the float arm when the float arm is retained as the magnet is rotated. A reed switch is mounted on the support bracket near the magnet such that when the float arm is in a predetermined range of angular position relative to the horizontal, the reed switch is actuated by the magnet.

28 Claims, 4 Drawing Sheets

LIQUID LEVEL SWITCH ASSEMBLY

TECHNICAL FIELD OF THE INVENTION

The present invention relates to a liquid level switch assembly with a magnetic switch that is actuated when a float arm pivotally connected to a stationary arm pivots to a predetermined angular position relative to the stationary arm as a result of the liquid level in the tank. In one aspect, the present invention relates to such a switch assembly wherein the angular position of the float arm relative to the stationary arm at which the magnetic switch is actuated can be readily adjusted.

BACKGROUND OF THE INVENTION

Tanks are commonly equipped with a liquid level switch assembly having a float arm pivotally connected to a stationary arm which is mounted to the tank. The entire float arm can be buoyant or a float can be attached to the float arm at some point. The float arm pivots in response to fluctuations in the liquid level in the tank. Some switch assemblies of this type have a magnet fixed to one arm and a magnetically actuated switch fixed to the other such that when the float arm has pivoted to a predetermined angular position relative to the stationary arm, the magnet will actuate the magnetic switch. Such a switch assembly is shown in U.S. Pat. No. 4,513,185.

A significant drawback of this type of switch assembly is that the angular position of the float arm relative to the stationary arm at which the magnet actuates the switch is not adjustable. Such non-adjustable switches are severely limited in their ability to be adapted to different applications such as different size tanks or different liquid levels at which it is desired for the switch to be actuated. For example, the design of a switch assembly developed to be actuated by a low liquid level of two inches in a two foot deep tank will minimally contain the following elements: 1) the length of the stationary arm; 2) the mounting position of the stationary arm on the tank; 3) the length of the float arm; and 4) the position of the float arm relative to the stationary arm at which the magnet will actuate the switch. However, if the liquid level at which the switch is desired to be actuated is changed from two inches to five inches, or if some of the tanks are two and a half feet deep instead of two feet, the design developed for the two inch, two foot application can not be readily adapted for these new applications. In order to provide a switch for the new applications, one or more of the four basic elements of the design will have to be changed. However, changing the lengths of the arms or the position of the switch assembly on the tank can involve repeated expensive design, component, manufacturing and/or installation changes for each new application that is encountered.

Thus, a need exists for a switch assembly which can be readily adapted for a wide range of applications without having to change the size of its components or its position on the tank. The present invention provides for a switch assembly in which the angular position of the float arm relative to the stationary arm at which the magnetic switch is actuated is readily adjustable, thus allowing the present invention to be readily adapted to a wide range of applications without having to change its structure or its position on the tank.

The advantages of the present invention include the ability to develop a switch assembly that can be easily adjusted for use in a wide range of applications instead of having to change the design, structure and/or installation of the switch assembly for each different application. Additionally, such an adjustable switch assembly greatly simplifies the manufacture of several assemblies in that the same components and manufacturing procedures will be used for each assembly and do not nave to be repeatedly altered to make a different switch assembly for each different application.

SUMMARY OF THE INVENTION

The present invention provides a liquid level switch assembly adapted for attachment to a tank. In one aspect of the present invention, the switch assembly comprises a support bracket with one end adapted for attachment to the tank and another end for extending into the interior of the tank. A pivot axle is rotatably mounted to the support bracket inside the tank, and a float arm extends from the pivot axle in a direction nonparallel to the rotational axis of the pivot axle. At least part of the float arm is buoyant, and the float arm is pivotable about the rotational axis of the pivot axle. A magnet is mounted on the pivot axle so as to rotate about the rotational axis of the pivot axle as the float arm pivots. The magnet is also adjustable about the rotational axis of the pivot axle so that the angular position of the magnetic poles of the magnet with respect to the float arm can be adjusted. A magnetically actuated contact is attached to the support bracket and positioned relative to the magnet such that when the float arm is within a predetermined range of angular position relative to the support bracket, the magnet actuates the contact.

A further aspect of the present invention provides a switch assembly as just described but further comprising a carrier ring that is snugly fit concentrically around part of the pivot axle such that rotation of the pivot axle rotates the carrier ring but such that the ring can be rotated relative to the pivot axle when the pivot axle is retained as the ring is rotated. Furthermore, the magnet is fixed to the ring such that adjustment of the ring relative to the pivot axle adjusts the angular position of the poles of the magnet relative to the float arm.

Another aspect of the present invention provides a switch assembly where the angular position of the switch, instead of the magnet, is adjustable. Thus, the angular position of the float arm relative to the support bracket at which the switch is actuated is readily adjustable by adjusting the position of the switch.

DETAILED DESCRIPTION OF THE PREFERRED EMBODIMENT

Figure 1:
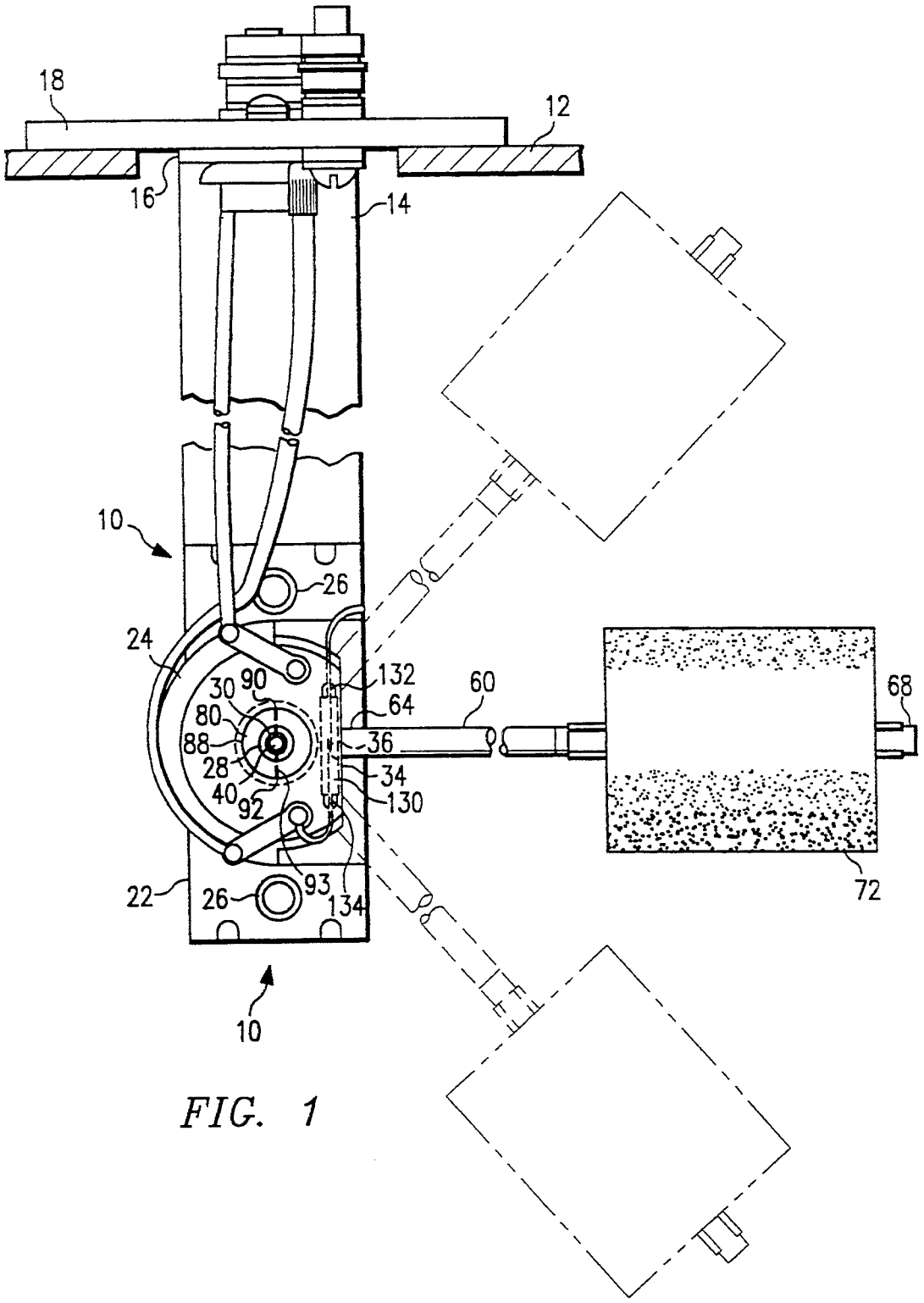
FIG. 1 is a side view of the preferred embodiment of the switch assembly of the present invention.
Figure 2:
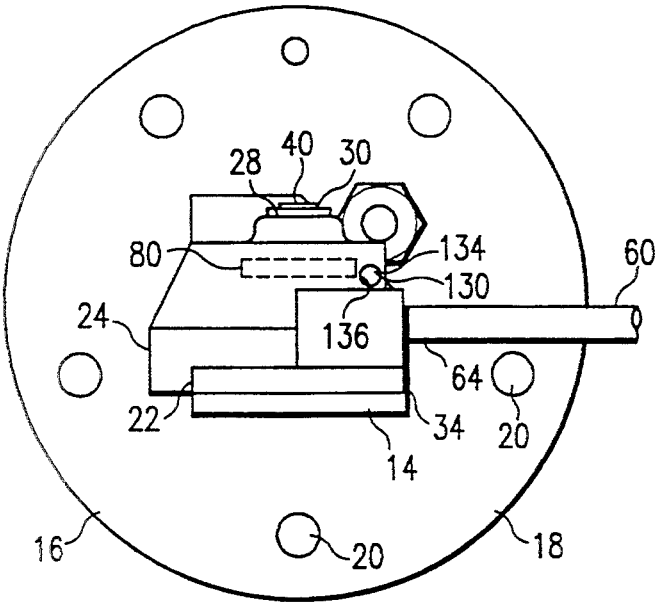
FIG. 2 is a bottom view of the preferred embodiment of the switch assembly of the present invention.

With reference to FIGS. 1 and 2, the preferred embodiment of the switch assembly of the present invention is shown. Like numbers refer to corresponding parts in different figures. Switch assembly 10 is mounted to tank 12 to respond to a predetermined range of liquid level in tank 12. Switch assembly 10 comprises a support bracket 14 with a first end 16 adapted for attachment to tank 12. First end 16 comprises a mounting plate 18 with mounting holes 20 through which fasteners, for example screws or rivets, can be placed to attach mounting plate 18 to tank 12. It should be understood that first end 16 can be adapted for any tank and FIGS. 1 and 2 show a preferred structure of first end 16 for a specific application. Support bracket 14 has second end 22 which communicates with the interior of the tank.

Figure 3:
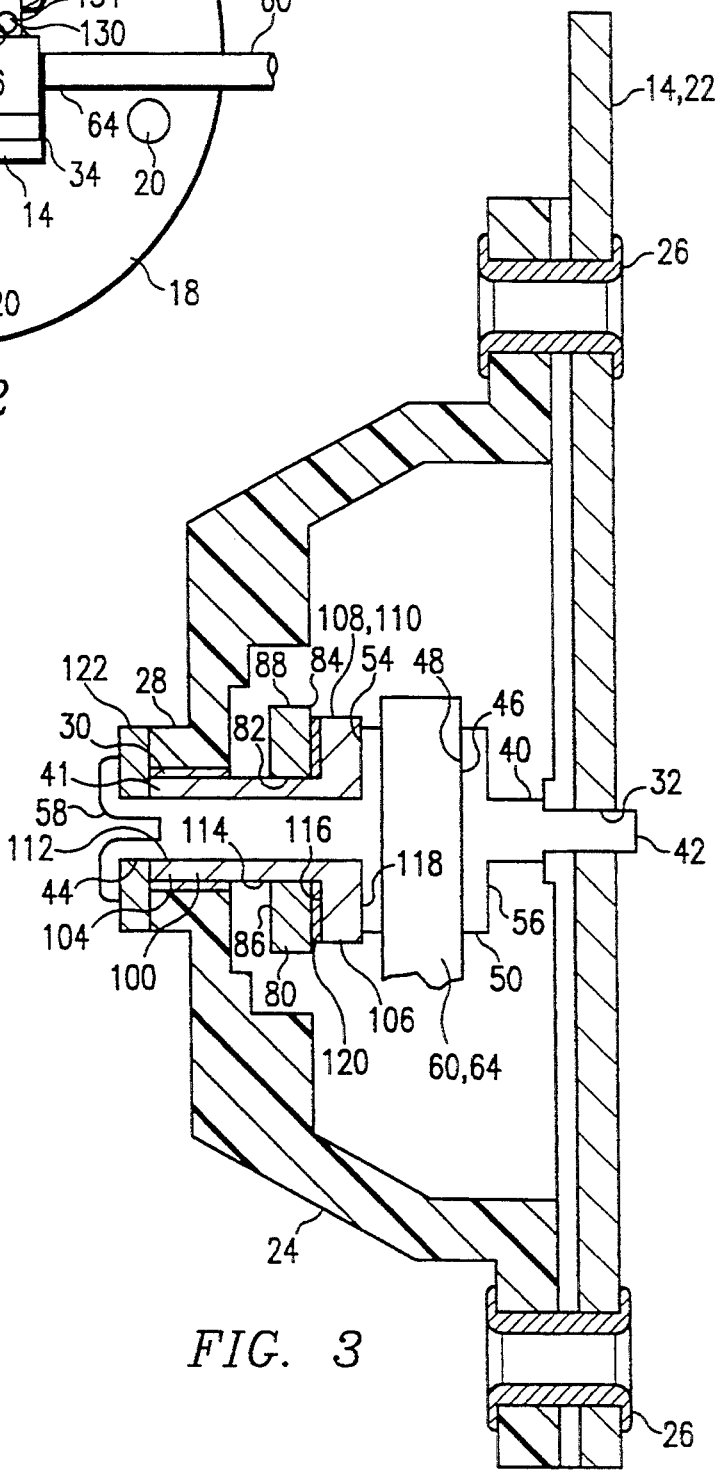
FIG. 3 is a longitudinal cross-sectional view along line 3—3 in FIG. 1.

With additional reference to FIG. 3, second end 22 comprises a portion of support bracket 14 and housing 24 mounted thereto with rivets 26. Housing 24 has hub portion 28 defining a hole 30 opposite hole 32 in support bracket 14. Housing 24 has an open side 34 indicated on FIGS. 1 and 2.

Figure 4:
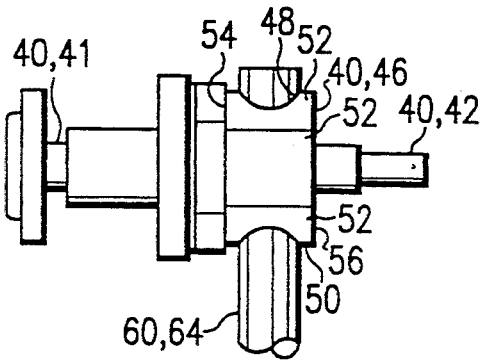
FIG. 4 is a frontal view of the pivot assembly of the preferred embodiment of the switch assembly of the present invention.

With additional reference to FIG. 4, pivot axle 40 is rotatably mounted in second end 22. Pivot axle 40 has a first end 41 disposed through hole 30 and second end 42 disposed through hole 32. Pivot axle 40 has a block portion 46 that has passageway 48 extending therethrough. Block portion 46 has outer periphery 50 in a hexagonal shape to provide flat surfaces 52 so that outer periphery 50 can be engaged by a wrench about two opposing flat surfaces 52 thus providing an adjustment means. Block portion 46 has a first lateral surface 54 facing towards first end 41 of pivot axle 40 and second lateral surface 56 facing towards second end 42 of pivot axle 40.

Float arm 60 extends from pivot axle 50 in a direction non-parallel to the rotational axis of pivot axle 40. Preferably, float arm 60 is perpendicular to the rotational axis of pivot axle 40, but certain applications may dictate that float arm extend obliquely from the rotational axis. Float arm 60 has a proximal end 64 at pivot axle 40 and a distal end 68 with the float 72 attached thereto. Float arm 60 is pivotable about the rotational axis of pivot axle 40. Proximal end 64 is inserted into passageway 48 of block portion 46. Proximal end 64 can be retained in passageway 48 by any suitable means. In the preferred embodiment, block portion 46 is crimped around proximal end 64. A crimping device can be placed about two opposing flat surfaces 52 to crimp block portion 46 around proximal end 64. If desired, the float arm and pivot axle may be made of a single piece.

Figure 5B:
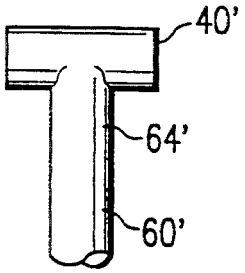
FIG. 5B is a frontal view of the alternative embodiment of FIG. 5A.
Figure 5A:
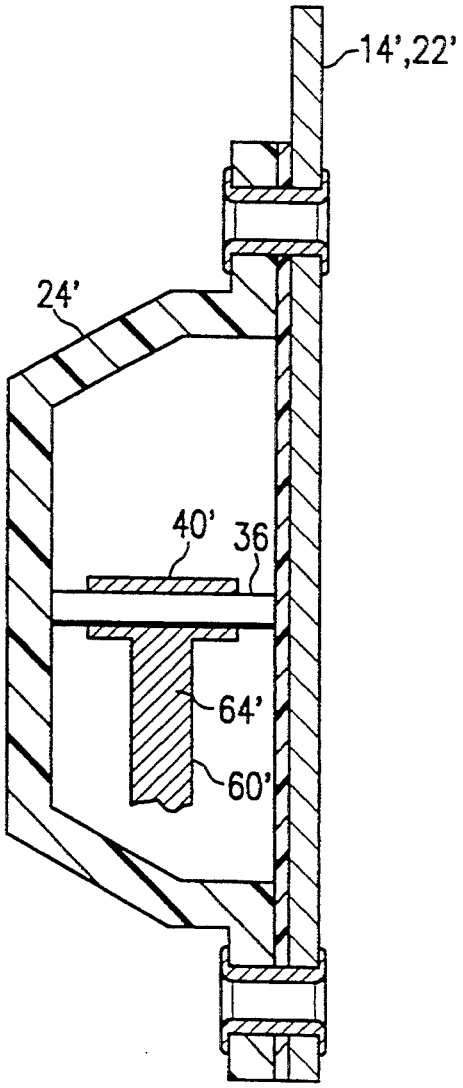
FIG. 5A is a longitudinal cross-sectional view of an alternative embodiment of the pivot assembly.

In an alternative embodiment shown in FIGS. 5A and 5B, pivot axle 40' and proximal end 64' of float arm 60' are of a one piece T-shape construction. Second end 22' of support bracket 14' comprises a pin 36 fixed at one end to housing 24' and at the other end to support bracket 14'. Pivot axle 40' is generally annular and is rotatably mounted about pin 36.

Float 72 rises and falls with the liquid level in tank 12 by swinging arcuately up and down about the rotational axis of pivot axle 40. The length and configuration of float arm 60 as well as the size and type of float 72 are a matter of the parameters of a specific application, for example, size of tank, placement of switch assembly, type of liquid, etc.

Carrier ring 100 is snugly fit concentrically around part of pivot axle 40. Inside surface 112 of carrier ring 100 is frictionally engaged with outside surface 44 of pivot axle 40 such that carrier ring 100 moves with pivot axle 40 but such that carrier ring 100 can be rotated relative to pivot axle 40 if pivot axle 40 is restrained from rotation as carrier ring 100 is rotated. Carrier ring 100 comprises sleeve 104 with flange 106. Flange 106 has outer periphery 108 in a hexagonal shape to provide flat surfaces 110 so that outer periphery 108 can be engaged by a wrench about two opposing flat surfaces 110. To rotationally adjust the carrier ring 100 with respect to pivot axle 40, float arm 60 can be retained stationary while a wrench is engaged about outer periphery 108 of flange 106 and turned to overcome the frictional engagement between inside surface 112 of carrier ring 100 and outside surface 44 of pivot axle 40 to rotate carrier ring 100 about the rotational axis of pivot axle 40. Flange 106 has first lateral side 116 facing first end 41 of pivot axle 40 and second lateral side 118 facing first lateral side 54 of block portion 46 of pivot axle 40.

Carrier ring 100 is preferably brass and is pressed over first end 41 of pivot axle 40. First end 41 can then be deformed to raise a radial ridge 58 and retaining washer 122 is placed between radial ridge 58 and the end of sleeve 104.

Magnet 80 is fixed to carrier ring 100. Magnet 80 is preferably of a generally disc shape and has hole 82 through which sleeve 104 is inserted. Magnets of other shapes may be used. Hole 82 can be sized such that the inside of hole 82 frictionally engages with outside surface 114 of sleeve 104. Magnet 80 has first side 84 which is abutted against first lateral side 116 of flange 106 and second side 86 facing away from flange 106. Adhesive material 120 can be placed between first side 84 and first lateral side 116 to contribute to the attachment of magnet 80 to carrier ring 100. As carrier ring 100 is rotated, whether it be with pivot axle 40 or relative to the pivot axle 40 during adjustment, magnet 80 rotates with carrier ring 100.

Figure 6:
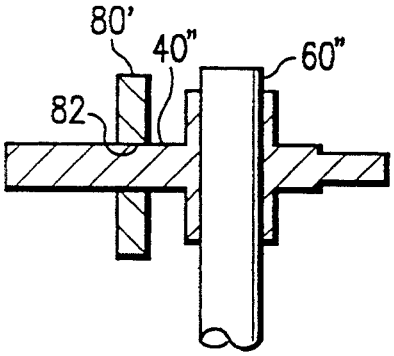
FIG. 6 is a longitudinal cross-sectional view of an alternative embodiment of the pivot assembly.

The present invention can be practiced without carrier ring 100. FIG. 6 shows an alternative embodiment where magnet 80' has hole 82 sized so that pivot axle 40'' fits snugly therethrough in frictional engagement such that magnet 80' moves with pivot axle 40'' but such that magnet 80' can be rotated relative to pivot axle 40'' if pivot axle 40'' is retained as magnet 80' is rotated. Magnet 80' could have a periphery including opposing flat surfaces so that a wrench could be used to adjust the angular position of magnet 80' relative to float arm 60''.

The preferred embodiment comprises carrier ring 100 so that the angular position of magnet 80 relative to float arm 60 can be adjusted without having to contact magnet 80 with a wrench which could potentially break or damage magnet 80. Magnet 80 has an outer diameter 88 and with reference back to FIG. 1, magnet 80 is preferably bipolar with its north pole 90 and south pole 92 positioned opposite each other on outside diameter 88 to define a polar axis 93. Thus, rotation of magnet 80 necessarily means rotation of the magnet's polar axis.

Magnetically actuated switch 130 is attached to second end 22 of support bracket 14. In the preferred embodiment, the magnetically actuated switch is a reed switch. Switch 130 is a normally open reed switch having a first end 132 and second end 134. Housing 24 has bore 136 through which switch 130 is disposed radially beyond the radial extent of magnet 80 and generally in the plane of rotation of magnet 80. Pivoting of float arm 60 rotates magnet 80 and thus changes the position of the north-south axis of magnet 80 relative to switch 130. Magnet 80 is such that a certain range of angular position of magnet 80 relative to switch 130 causes the reed switch to close or be actuated. If magnet 80 is in an angular position relative to switch 30 outside this range, the reed switch remains open, or unactuated. Because the angular position of the dipole axis of magnet 80 relative to float arm 60 can be adjusted, the position of the float, and thus the level of the liquid in the tank, at which switch 130 is actuated is correspondingly adjustable.

The adjustability of magnet 80 is advantageous in that the switch of the present invention can be used in a variety of different sized tanks and applications. For example, if it is desired to respond to a low liquid level in a tank, the vertical distance from the top of the low liquid level to the pivot axle can be determined. From this distance, it can be determined what angle that float arm 60 will have with respect to the horizontal. The float arm can be retained at this position while the angular position of the magnet is adjusted until the magnet just opens the reed switch. If the next tank is shallower, the magnet on another of the same type switch can be adjusted accordingly to account for the changed low liquid level relative to the pivot axle.

Figure 7A:
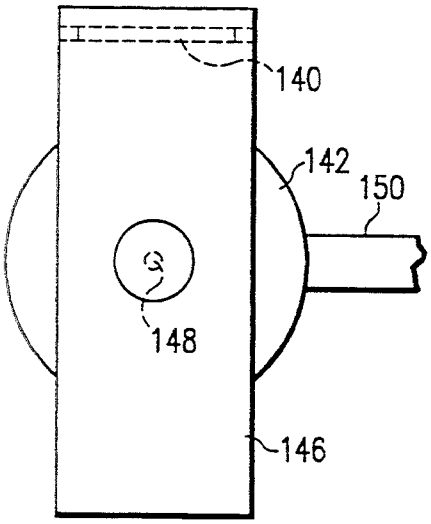
FIG. 7A is a partial side view of an alternative embodiment of the switch assembly.
Figure 7B:
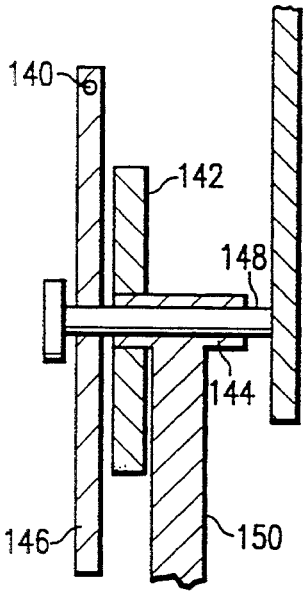
FIG. 7B is a longitudinal cross-section of the alternative embodiment of FIG. 7A.

In an alternative embodiment shown in FIGS. 7A and 7B, the position of switch 140 is adjustable instead of magnet 142. Magnet 142 is attached to pivot axle 144. Switch 140 is mounted on member 146 which is frictionally engaged on pin 148. As float arm 150 pivots, magnet rotates relative to member 146. The angular position of member 146 can be adjusted by rotating member 146 about pin 148. Thus, the angular position of float arm 150 at which switch 140 is actuated can be readily adjusted.

Switch 10 can be used to respond in a number of ways to a low liquid level. When reed switch closes, a circuit can be completed which powers an annunciator, for example. a light or audible alarm. Alternatively, closing of the reed switch can turn on a refill pump to replenish the tank. Switch 10 can be used to respond to a high liquid level as well as a low liquid level. Switch 10 can open a drain valve or shut off a refill pump when a high liquid level is reached.

In a further embodiment, more than one switch can be positioned around the rotational axis such that the magnet will successively actuate the switches as the float arm pivots. Each switch can provide for a different response. For example, one switch can indicate a low liquid level while the other switch can indicate a high liquid level.

Figure 8:
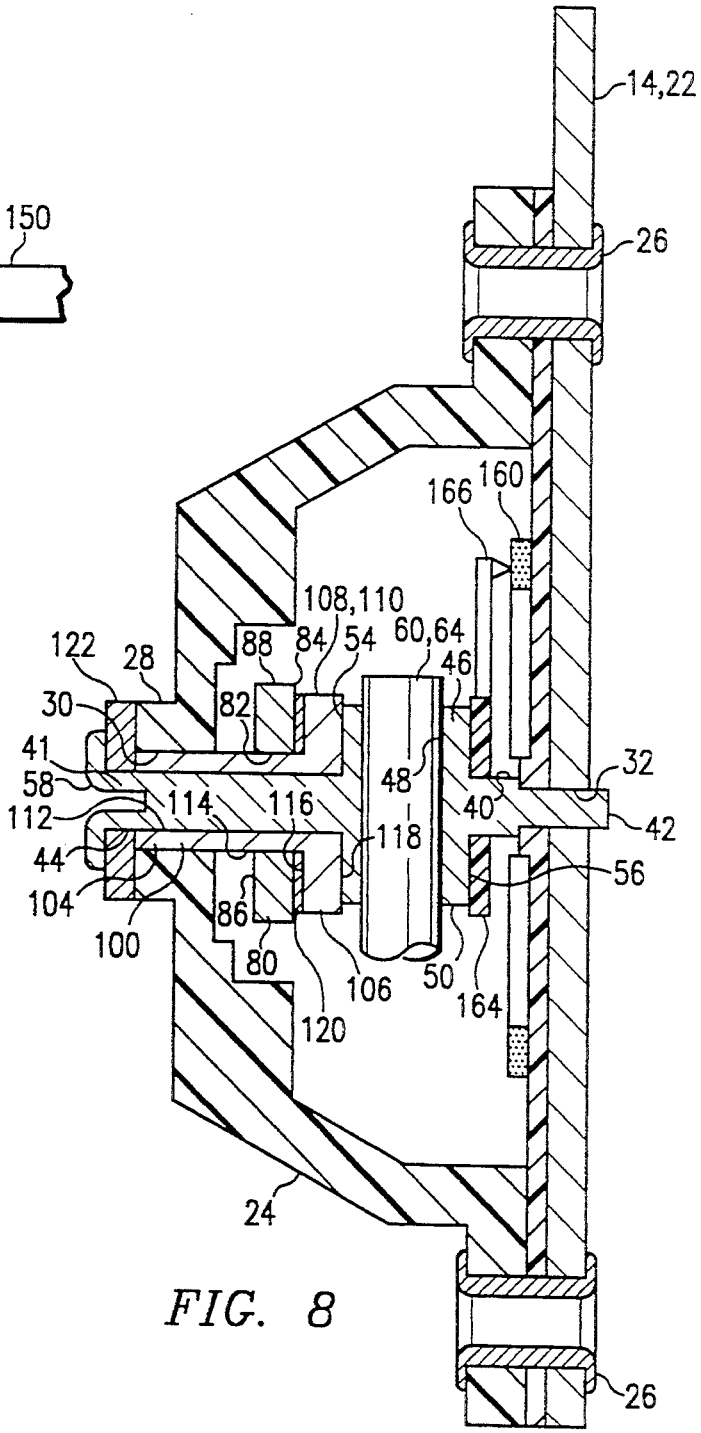
FIG. 8 is a longitudinal cross-sectional view of an alternative embodiment of the present invention.

FIG. 8 shows another embodiment with the magnet and switch assembly used in combination with an arcuate variable resistor 160. Variable resistor 160 is mounted in housing 24. Contact 164 is mounted to pivot axle 40 and has tongue 166 extend radially outward and in contact with variable resistor 160. Thus, as the float arm pivots, the extent of arc of the variable resistor that the current travels through changes thus providing signal proportional to the liquid level in the tank. Using the variable resistor in combination with the magnet and switch allows both a continuous display of the liquid level and a switch that automatically reacts to a predetermined liquid level in the tank.

Although a single embodiment of the invention has been illustrated in the accompany drawings and described in the foregoing Detailed Description, it will be understood that the invention is not limited to the embodiment disclosed, but is capable of numerous rearrangements, modifications and substitutions of parts and elements without departing from the spirit of the invention.

I claim:

1. A liquid level switch assembly adapted for attachment to a tank, comprising:

(a) a support bracket having a first end adapted for attachment to the tank and a second end adapted for communication with the interior of the tank;

(b) a float arm having a proximal end and a distal end, said proximal end having a pivot axle rotatably connected with said second end of said support bracket to define a pivot axis through said pivot axle about which said float arm pivots;

(c) a magnet having magnetic poles defining a polar axis, said magnet adjustably mounted to said float arm such that the angular position of said polar axis of said magnet relative to said float arm can be readily adjusted;

(d) a magnetically actuated switch attached to said second end of said support bracket and positioned relative to the pivot axis of said float arm such that when said float arm is in a predetermined range of angular position relative to said support bracket, the position of said polar axis of said magnet relative to said switch is such to actuate said switch; and (e) a carrier ring that is snugly fit concentrically around part of said pivot axle such that rotation of said pivot axle rotates said ring but such that said ring can be rotated relative to said pivot axle when said pivot axle is retained as said ring is rotated; and wherein said magnet is fixed to said ring.

2. A liquid level switch assembly in accordance with claim 1 wherein said pivot axle comprises at least one protrusion extending out from one side of said float arm and said second end of said support bracket defines at least one hub to rotatably receive said protrusion.

3. A liquid level switch assembly in accordance with claim 1 wherein said pivot axle is in a hole extending laterally through said float arm and said second end of said support bracket comprises a protrusion rotatably disposed through said hole.

4. A liquid level switch assembly in accordance with claim 2 wherein said magnet is generally disc shaped with a hole in its middle through which said pivot axle extends.

5. A liquid level switch assembly in accordance with claim 1 wherein said ring has an outer periphery with opposing flat surfaces to permit rotation of said ring about said pivot axle by a wrench.

6. A liquid level switch assembly in accordance with claim 1 wherein said carrier ring comprises a sleeve with a flange and said magnet is generally disc shaped with a hole through its middle through which said sleeve is inserted, said flange having an outer periphery with opposing flat surface to permit rotation of said ring about said pivot axle by a wrench.

7. A liquid level switch assembly in accordance with claim 6 wherein said magnet has a first side abutted against said flange and a second side facing away from said flange; and further comprising an adhesive material between said first side and said flange to facilitate the attachment of said magnet to said ring.

8. A liquid level switch assembly in accordance with claim 1 wherein said magnet has a hole through which said pivot axle is disposed.

9. A liquid level switch assembly in accordance with claim 8 wherein said magnet is generally disc shaped with an outer diameter and said hole is concentric with said outer diameter.

10. A liquid level switch assembly in accordance with claim 9 wherein said magnet has a north pole and a south pole positioned opposite each other on said outer diameter.

11. A liquid level switch assembly in accordance with claim 1 wherein said switch is a normally open reed switch.

12. A liquid level switch assembly in accordance with claim 11 wherein said reed switch is positioned radially beyond the radial extent of said magnet.

13. A liquid level switch assembly in accordance with claim 11 wherein said reed switch is generally in the plane of rotation of said magnet.

14. A liquid level switch assembly in accordance with claim 1 further comprising an arcuate variable resistor attached to said second end about the pivot axis and a contact attached to said pivot axle extending radially outwardly in slidable contact with said variable resistor.

15. A liquid level switch assembly adapted for attachment to a tank, comprising:

(a) a support bracket having a first end adapted for attachment to the tank and a second end adapted for communication with the interior of the tank;

(b) a float arm having a proximal end and a distal end, said proximal end having a pivot axle rotatably connected with said second end of said support bracket to define a pivot axis through said pivot axle about which said float arm pivots;

(c) a magnet having magnetic poles defining a polar axis, said magnet adjustably mounted to said float arm such that the angular position of said polar axis of said magnet relative to said float arm can be readily adjusted, said magnet having a hole through which the pivot axle is disposed;

(d) a magnetically actuated switch attached to said second end of said support bracket and positioned relative to the pivot axis of said float arm such that when said float arm is in a predetermined range of angular position relative to said support bracket, the position of said polar axis of said magnet relative to said switch is such to actuate said switch.

16. A liquid level switch assembly in accordance with claim 15 wherein said pivot axle comprises at least one protrusion extending out from one side of said float arm and said second end of said support bracket defines at least one hub to rotatably receive said protrusion.

17. A liquid level switch assembly in accordance with claim 15 wherein said pivot axle is a hole extending laterally through said float arm and said second end of said support bracket comprises a protrusion rotatably disposed through said hole.

18. A liquid level switch assembly in accordance with claim 16 wherein said magnet is generally disc shaped with a hole in its middle through which said pivot axle extends.

19. A liquid level switch assembly in accordance with claim 15 further comprising a carrier ring that is snugly fit concentrically around part of said pivot axle such that rotation of said pivot axle rotates said ring but such that said ring can be rotated relative to said pivot axle when said pivot axle is retained as said ring is rotated; and wherein said magnet is fixed to said ring.

20. A liquid level switch assembly in accordance with claim 19 wherein said ring has an outer periphery with opposing flat surfaces to permit rotation of said ring about said pivot axle by a wrench.

21. A liquid level switch assembly in accordance with claim 19 wherein said carrier ring comprises a sleeve with a flange and said magnet is generally disc shaped with a hole through its middle through which said sleeve is inserted, said flange having an outer periphery with opposing flat surface to permit rotation of said ring about said pivot axle by a wrench.

22. A liquid level switch assembly in accordance with claim 21 wherein said magnet has a first side abutted against said flange and a second side facing away from said flange; and further comprising an adhesive material between said first side and said flange to facilitate the attachment of said magnet to said ring.

23. A liquid level switch assembly in accordance with claim 15 wherein said magnet is generally disc shaped with an outer diameter and said hole is concentric with said outer diameter.

24. A liquid level switch assembly in accordance with claim 23 wherein said magnet has a north pole and a south pole positioned opposite each other on said outer diameter.

25. A liquid level switch assembly in accordance with claim 15 wherein said switch is a normally open reed switch.

26. A liquid level switch assembly in accordance with claim 25 wherein said reed switch is positioned radially beyond the radial extent of said magnet.

27. A liquid level switch assembly in accordance with claim 25 wherein said reed switch is generally in the plane of rotation of said magnet.

28. A liquid level switch assembly in accordance with claim 15 further comprising an arcuate variable resistor attached to said second end about the pivot axis and a contact attached to said pivot axle extending radially outwardly in slidable contact with said variable resistor.

* * * * *